US011897723B2

(12) United States Patent
Buck

(10) Patent No.: US 11,897,723 B2
(45) Date of Patent: Feb. 13, 2024

(54) HOSE STORAGE CONTAINER

(71) Applicant: J. M. Rock Family Trust, Key Largo, FL (US)

(72) Inventor: Larry Ray Buck, Fort Worth, TX (US)

(73) Assignee: J. M. Rock Family Trust, Key Largo, FL (US)

( * ) Notice: Subject to any disclaimer, the term of this patent is extended or adjusted under 35 U.S.C. 154(b) by 722 days.

(21) Appl. No.: 17/028,840

(22) Filed: Sep. 22, 2020

(65) Prior Publication Data

US 2022/0089405 A1 Mar. 24, 2022

(51) Int. Cl.
*B65D 85/04* (2006.01)
*B65H 75/36* (2006.01)

(52) U.S. Cl.
CPC ..... *B65H 75/362* (2013.01); *B65D 85/04* (2013.01); *B65H 2402/442* (2013.01); *B65H 2701/33* (2013.01)

(58) Field of Classification Search
None
See application file for complete search history.

(56) References Cited

U.S. PATENT DOCUMENTS 4,588,083 A 5/1986 Hunt
4,793,376 A 12/1988 Hare
4,979,679 A 12/1990 Downs
4,984,685 A * 1/1991 Douglas ..... H01R 13/72 206/408
5,011,034 A 4/1991 Abel
5,103,977 A * 4/1992 Douglas ..... G02B 6/4457 206/408
5,349,992 A 9/1994 Gallo et al.
5,421,457 A 6/1995 Listenberger
5,511,720 A 4/1996 Zaborszki et al.
5,919,359 A 7/1999 Bisseker
5,988,207 A 11/1999 Kownacki et al.
6,367,403 B1 4/2002 Carter
6,546,953 B1 4/2003 Kowalke
7,438,250 B2 10/2008 Anderson et al.
8,253,073 B2 * 8/2012 Marcotte ..... H05B 3/58 239/196
9,066,633 B1 * 6/2015 Meriwether ..... A47K 3/022
2002/0000720 A1 * 1/2002 Knowles ..... F16L 27/0804 285/308
2010/0200559 A1 * 8/2010 Marcotte ..... H05B 3/58 219/214
2011/0290827 A1 * 12/2011 Gilpatrick ..... A01G 25/00 222/401
2013/0239994 A1 * 9/2013 Przyjemski ..... B08B 9/0321 134/22.12
2014/0262866 A1 * 9/2014 Burrous ..... B25H 3/021 206/409

(Continued)

*Primary Examiner* — Steven M Marsh
(74) *Attorney, Agent, or Firm* — David W. Carstens; Carstens, Allen & Gourley, LLP

(57) ABSTRACT

A hose storage container designed to reduce exposure of the stored hose to UV light. The container includes an enclosure unit with a removable lid, a fastening line, and a conduit. The conduit passes through the sidewall of the enclosure and is comprised two threaded points, one on each end of the conduit, and the connection between them. The conduit is constructed of a UV resistant material and serves to increase protection of the hose from UV light and other elements.

8 Claims, 4 Drawing Sheets

(56) References Cited

U.S. PATENT DOCUMENTS

| | | | | |
|---|---|---|---|---|
| 2018/0280838 | A1 | 10/2018 | Johnson et al. | |
| 2020/0156977 | A1 | 5/2020 | Kirkendall | |
| 2020/0385232 | A1* | 12/2020 | González | B65H 57/06 |

* cited by examiner

HOSE STORAGE CONTAINER

FIELD OF INVENTION

This disclosure relates to the storage of water hoses, particularly in outdoor environments, such as on or around watercraft, where the hose will be prone to degradation from increased exposure to UV light and other environmental conditions.

BACKGROUND OF INVENTION

A variety of different devices are used to store water hoses. These devices are generally containers of varying shape and size. Additionally, there are several "hose caddies" and other similar devices in existence which fulfill similar roles. Often, water hoses become entangled when stored improperly, and they degrade rapidly when not kept correctly. One of the biggest factors that leads to degradation and corrosion of outdoor hoses is UV light. On top of this, hoses can be cumbersome and tedious to transport. Thus, a method of protection from degradation and safe storage is desired.

This invention is a unique solution to many of the issues encountered by other hose storage appliances. For example, FIG. 1 shows a container disclosed in U.S. Pat. No. 5,421,457. The hose storage container has two opening for feeding a hose 12 into and out of the container 10. The container has a storage portion 20 and a lid 30. The storage portion 20 includes a drainage hole 24 in base 22. The lid 30 snaps onto the portion 20 with the lip 38 and detent 39. A flare 34 defines an opening 40 in the lid 30. While the container 10 does shield the hose 12, it is difficult to use. The hose must be threaded through the openings. Also, the length of hose that hangs outside the container must be sufficiently long to get to a water source. But most importantly, the portion of the hose 12 that is outside the container is unprotected and subject to the very degradation that the rest of the hose is protected from. Yet, if any one part of the hose fails, it all fails.

Other existing products also have clear disadvantages. Many homeowners own a "hose caddy" for the purpose of storing a water hose in their driveway, backyard, garage or somewhere else around their home. These devices often operate using a reel mechanism, which involves turning a hand crank to dispense and reel in the hose. This aides in transportation of the hose, particularly when reeling the hose in. However, the strain of reeling and dispensing a bulky hose often wears down the plastic components of hose caddies, causing them to fail in a relatively short amount of time. Additionally, most hose caddies leave the entire hose exposed to environmental conditions.

SUMMARY OF INVENTION

The current invention is a hose storage container. It can be outfitted for use near and on-board watercraft, such as when washing a boat. The primary objective of the invention is to offer maximum protection against the outdoor elements, specifically UV light, to extend the longevity of a hose. The device can make use of a stainless-steel coupler, rather than a simple hole, to protect the normally exposed portion of the hose outside of the container. This gives the hose superior protection against corrosion from UV light and other elements, as the entire surface area of the hose can be covered and protected while stored within the device. The built-in coupler or fluid conduit also allows for easy connection of the hose to a water source, or to another hose for extension. Suction cups can secure the device to a surface.

DETAILED DESCRIPTION OF INVENTION

Figure 1:
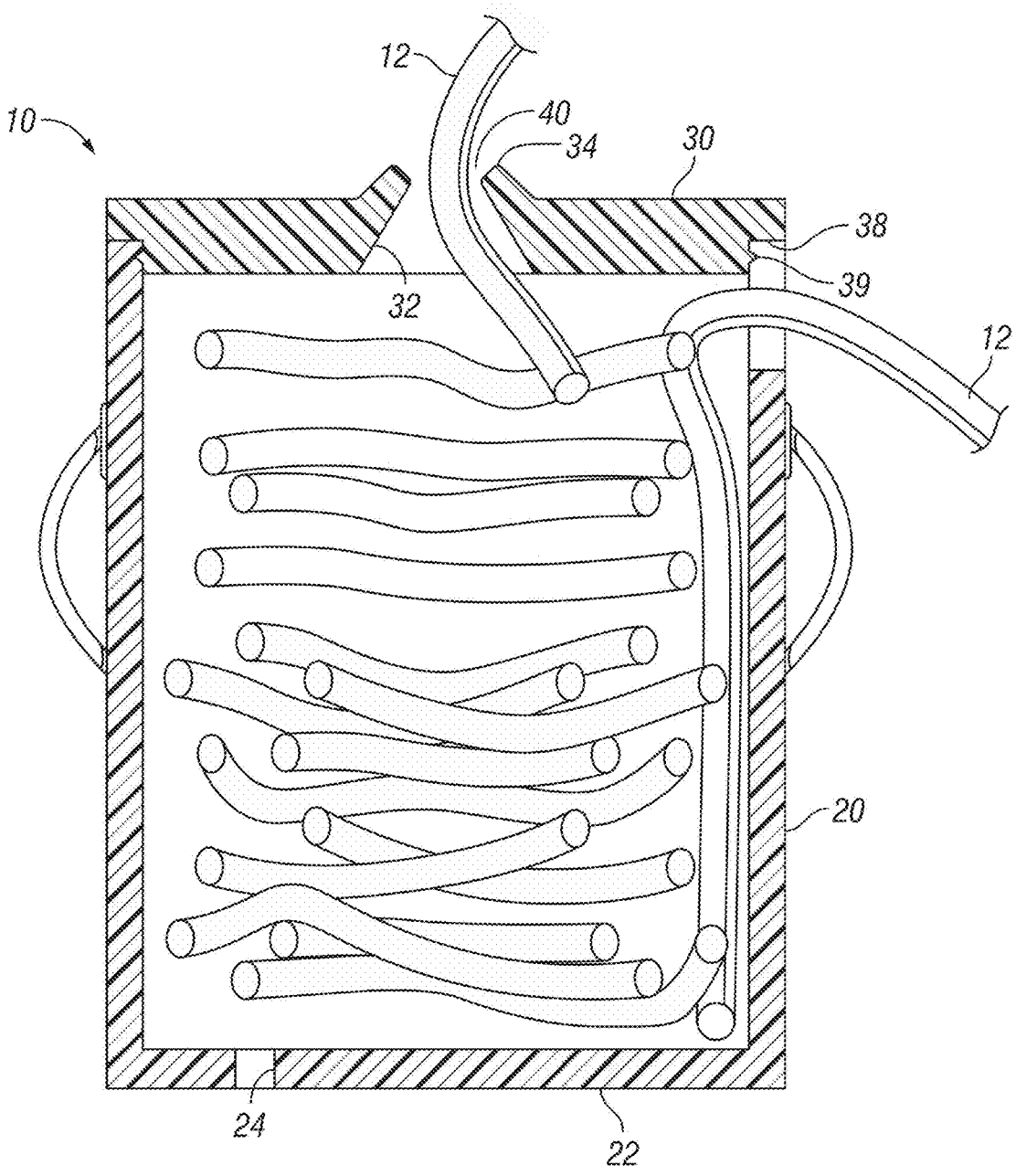
FIG. 1 (Prior Art)
FIG. 1 is a sectional view of a prior art device disclosed in U.S. Pat. No. 5,421,457.
Figure 2:
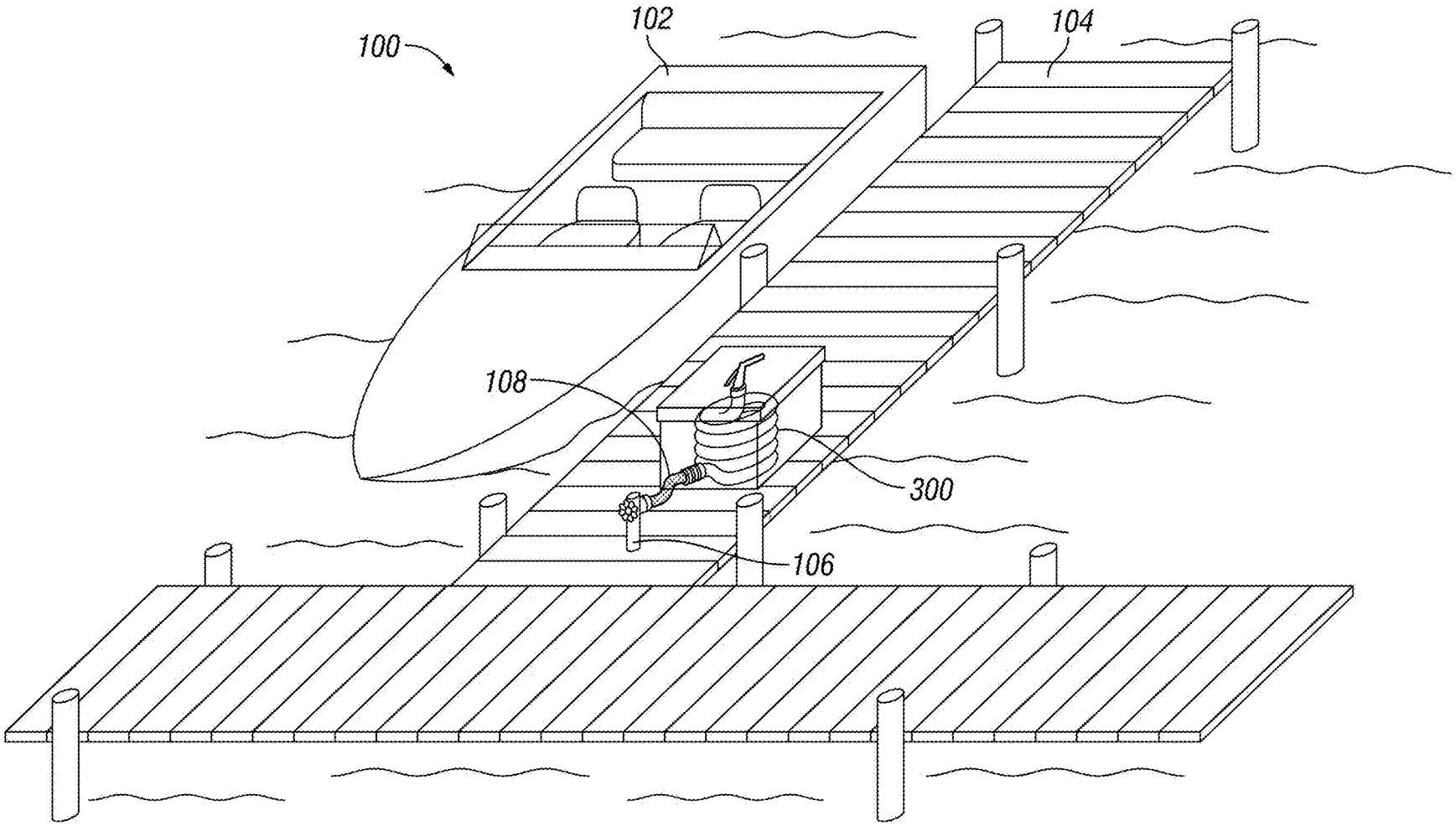
FIG. 2 is a perspective view showing an environment of usage for the hose storage device.

Storing a hose and protecting it from the elements is achieved with the storage device 300 shown in FIG. 2. Hoses are usually made from extruded synthetic rubber or soft plastic, often reinforced with an internal web of fibers. As a result of these materials, hoses are flexible and their smooth exterior facilitates pulling them past trees or other obstacles. Recently, expandable hoses have become more popular. These hoses expand to a full length when internally pressurized by water. Once the flow of water is reduced, the hose shrinks to a compact size. These hoses are made of two or more layers of latex. Other versions have a thermoplastic co-polyester core. Hoses also have fittings made of plastics or sometimes metals such as brass. In all situations, the materials can degrade due to environmental factors such as UV light or salt water.

To improve the useful life of a hose, a container 300 is provided. In this example 100, the unit 300 is located on a dock 104 that extends over the water, A boat 102 is shown next to the dock and a fresh water source 106, such as a hose bib, is provided on the dock 104. A user can attach the water source to the container 300 by means of a fluid conduit 108. Conduit 108 is coupled to the container 300 so that a fluid passage is established through the wall of the container. An appropriate coupler is attached to the exposed end of the conduit 108. A threaded female connector can be used to attach the conduit to a hose. A different coupler is located inside the container 300. In use, the stored hose is coupled to the connector on the inside of the container. When water pressure is applied, it flows through the conduit 108 and is available to the stored hose. The user simply opens the container and pulls the free end of the hose out and uses it to wash down an object.

Figure 3:
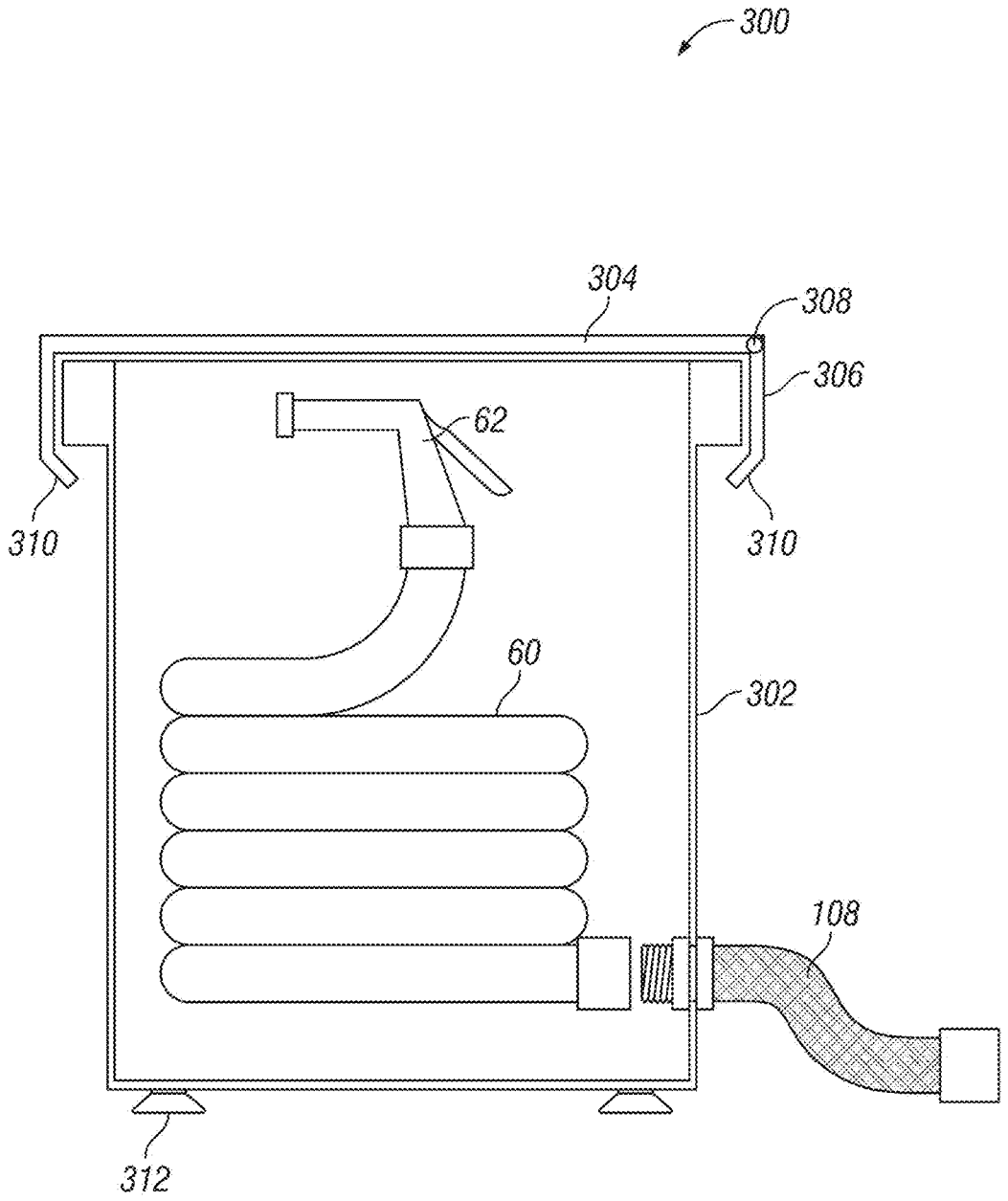
FIG. 3 is a side cut-away view of the present invention, showing the hose enclosure having a fluid conduit passing through a side wall.
Figure 4:
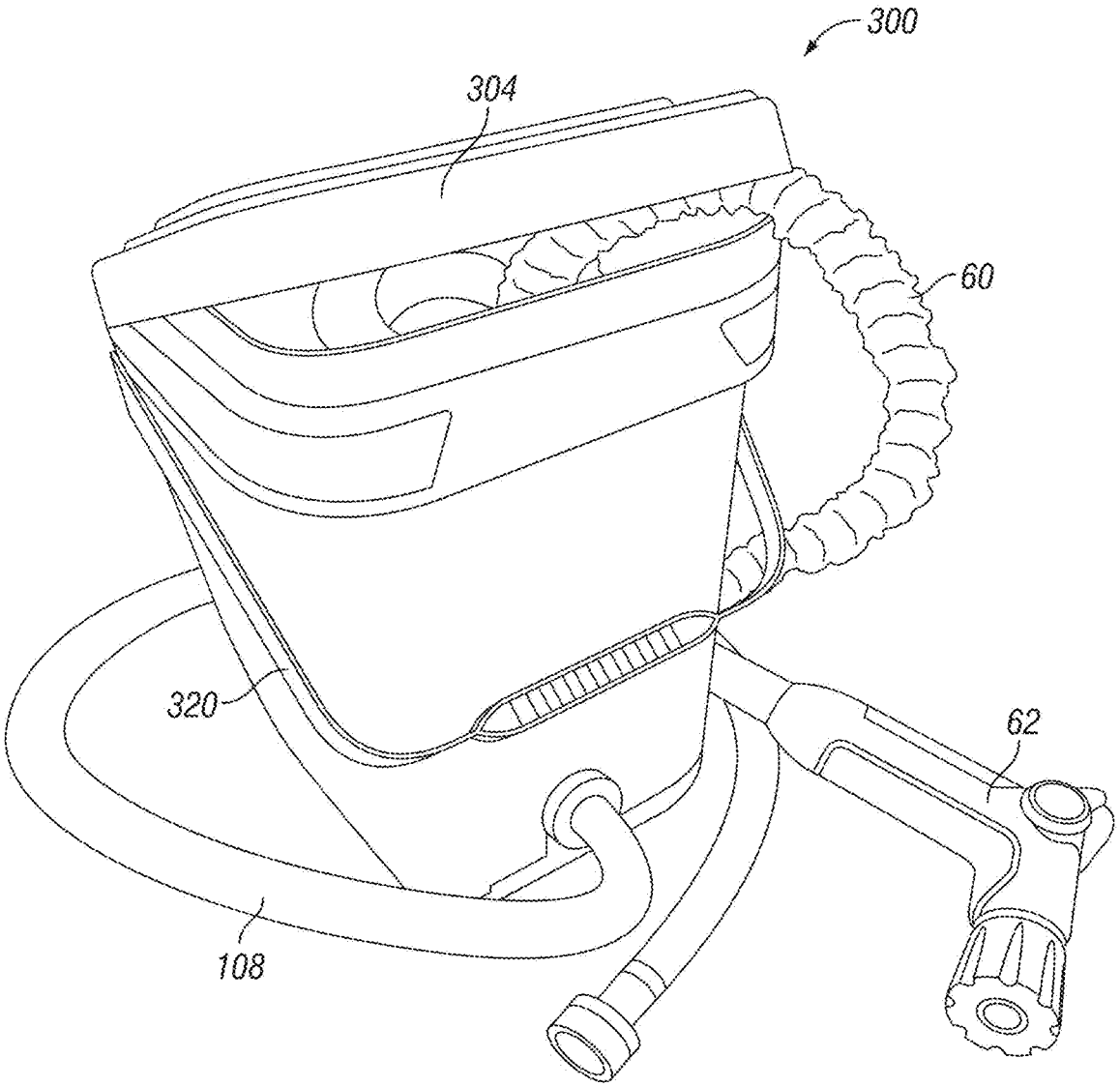
FIG. 4 is a perspective view of the device with the lid partially open and the stored hose partially extended.

Referring to FIG. 3, additional detail is provided for the storage device 300. Conduit 108 is shown providing a fluid path through the wall 302 of the container 300. The conduit is secured to a wall of the enclosure by fittings. The fittings can provide a fluid tight seal to prevent water or other destructive elements to enter the enclosure. A lid 304 can be used to cover the container portion 302. The lid can be secured by any number of methods. In this illustration, flexible tabs 310 snap over a lip of the container portion 302. In one embodiment, suction cups 312 can help secure the container to a surface. The lid can have a generally flat surface. A hinge 308 can allow a portion of the lid to be opened without the need to unlatch the lid from the container. FIG. 4 also shows the lid partially opened to reveal the hose 60 inside. The hose 60 can include a spray head.

What is claimed:

1. A container for use with a hose, the container comprising:

(a) an enclosure with a removable lid;

(b) a conduit passing through a wall of the enclosure;

wherein the conduit comprises a first end and a second end for accepting connections from a water source and a contained hose respectively;

wherein the second end of the conduit is secured to the wall of the enclosure by fittings;

wherein the conduit is configured to provide a continuous fluid passage from the water source to the contained hose;

wherein the conduit is built-in to the enclosure; and wherein the conduit is a UV resistant material.

2. The container of claim 1 wherein the conduit is a flexible stainless steel.

3. The container of claim 1 wherein the lid comprises a hinge allowing a portion of the lid to be raised while the remainder of the lid remains closed.

4. The container of claim 1 wherein the conduit further comprises:

(a) a first connector comprising threads located external to the enclosure to allow the conduit to be coupled to a water source; and (b) a second connector comprising threads located internal to the enclosure to allow the conduit to be coupled to a hose.

5. The container of claim 1 further comprises at least one suction cup located on the enclosure.

6. The container of claim 1 wherein the lid has a flexible flange on its perimeter to allow it to be secured to the enclosure.

7. The container of claim 4 wherein the second connector is a different coupler from the first connector.

8. The container of claim 7 wherein the fittings are fluid tight.

* * * * *